US005960802A

United States Patent [19]

Sakai

[11] Patent Number: 5,960,802

[45] **Date of Patent: *Oct. 5, 1999**

[54] PEN-TYPE CHEMICAL APPLICATOR

[75] Inventor: Eiichi Sakai, Nagaoka, Japan

[73] Assignee: TMC Kaken Kabushiki Kaisha, Nigata-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/758,000

[22] Filed: Nov. 27, 1996

[30] Foreign Application Priority Data

Dec. 6, 1995 [JP] Japan ..... 7-318397
Mar. 30, 1996 [JP] Japan ..... 8-104453

[51] Int. Cl.[6] ..... A45D 40/26

[52] U.S. Cl. ..... 132/320; 132/317; 132/208; 132/207; 401/199; 401/206

[58] Field of Search ..... 132/317, 320, 132/73, 218, 207, 208; 401/199, 206, 273, 278, 284, 260, 264

[56] References Cited

U.S. PATENT DOCUMENTS

| | | | |
|---|---|---|---|
| 328,427 | 8/1885 | Goncalves | 132/320 |
| 1,992,518 | 2/1935 | Werner | 132/320 |
| 3,966,336 | 6/1976 | Lotfallah | 401/199 |
| 4,588,319 | 5/1986 | Niemeyer | 401/199 |
| 4,770,558 | 9/1988 | Frietsch | 401/199 |
| 4,856,925 | 8/1989 | Konose | 401/290 |
| 4,913,175 | 4/1990 | Yokosuka et al. | 132/218 |
| 5,248,212 | 9/1993 | Lhuisset | 401/186 |
| 5,362,168 | 11/1994 | Abe et al. | 401/206 |
| 5,615,963 | 4/1997 | Kobayashi | 401/199 |

FOREIGN PATENT DOCUMENTS

| | | | |
|---|---|---|---|
| 0 320 131 | 6/1989 | European Pat. Off. | A45D 19/02 |
| 0 328 427 | 8/1989 | European Pat. Off. | A45D 34/04 |
| 0 375 856 | 7/1990 | European Pat. Off. | A45D 34/04 |
| 0 614 630 | 9/1994 | European Pat. Off. | A45D 40/26 |
| 2 520 209 | 1/1983 | France | A45D 34/04 |
| 375856 | 7/1990 | France | 132/218 |
| 35 36 332 | 4/1987 | Germany | B05C 17/00 |
| 38 07 563 | 9/1988 | Germany | A45D 34/04 |
| 38 35 299 | 12/1989 | Germany | B65D 47/26 |
| 3835299 | 12/1989 | Germany | 132/320 |
| 38 44 369 | 7/1990 | Germany | A45D 24/22 |

*Primary Examiner*—Gene Mancene
*Assistant Examiner*—Pedro Philogene
*Attorney, Agent, or Firm*—Sughrue, Mion, Zinn, Macpeak & Seas, PLLC

[57] ABSTRACT

A pen-type chemical applicator is provided for making it possible to easily and discretely apply a chemical such as a hair grower or a cosmetic chemical. In the pen-type chemical applicator, a pen tip member is provided at a distal end portion of a sleeve-like pen-like body which may be gripped by one hand and which contains a liquid, semisolid, paste-like, sol-like, or gel-like hair grower; the hair grower ejects or soaks out to the pen tip member or in the vicinity of the pen tip member; and the sharpness of the pen tip member is set to a stimulus that does not give a feeling of pain to a scalp when the pen tip member is brought into contact with the scalp.

8 Claims, 4 Drawing Sheets

PEN-TYPE CHEMICAL APPLICATOR

BACKGROUND OF THE INVENTION

The present invention relates to a pen-type chemical applicator by which a person may apply medicine such as hair grower or restorer or cosmetics even in front of others.

In general, a scalp applicable chemical such as hair grower or a chemical for cosmetic purpose such as cosmetic lotion is contained in a container such as a bottle and is sold on the market.

On the other hand, almost all of such chemicals are only effective for several hours, for example, 2 to 4 hours by one application although there is some difference in effective time depending upon the type of chemical. For this reason, in order to properly benefit from the chemicals effect, it is necessary to apply the chemicals many times a day. However, the bottle containing the chemicals is very difficult to carry with a user even if the bottle might be kept in his or her pocket or bag. The portability is very bad. Also, it is not practical for a business person or professional to bring a bottle containing these chemicals to the work place. In addition, the user is likely to be uncomfortable applying the chemicals in front of others. Accordingly, it is impractical to use such a bottle.

In addition, the conventional bottled product is not only inferior in portability but also needs a large space for storage. Almost all the users would like to purchase a supply of bottles for six months, one year or two years rather than one or two bottles in order to make a good purchase. However, it is sometimes difficult to maintain sufficient space for storage. This also raises a serious problem.

SUMMARY OF THE INVENTION

In view of the foregoing defects, an object of the present invention is to provide a novel pen-type chemical applicator by which a chemical or the like may be applied with ease and with a great efficiency, which is superior from an aspect of portability and storage, and which may be used stately without any hesitation in front of others.

According to a first aspect of the present invention there is provided a pen-type chemical applicator wherein a pen tip member is provided at a distal end portion of a sleeve-like pen-like body which may be gripped by one hand and which contains a liquid, semisolid, paste-like, sol-like, or gel-like hair grower; the hair grower ejects or soaks out to the pen tip member or in the vicinity of the pen tip member; and the sharpness of the pen tip member is set to a stimulus that does not give a feeling of pain to a scalp when the pen tip member is brought into contact with the scalp.

In the pen-type chemical applicator according to the first aspect of the invention, the pen tip member is constructed so that, when the pen tip member is brought into contact with scalp, the hair grower ejects or soaks out to the pen tip member or a periphery of the pen tip member.

In the pen-type chemical applicator according to the first aspect of the invention, the pen tip member is constructed so that, when side portions or parts of the pen-like body are pressed by fingers under the condition that the pen tip member is brought into contact with a scalp to rotate the ball member, the hair grower ejects or soaks out to the pen tip member or a periphery of the pen tip member.

In the pen-type chemical applicator according to the first aspect of the invention, a ball member is rotatably provided at the pen tip member, and the pen tip member is constructed so that, when the pen tip member is moved under the condition that the pen tip member is brought into contact with a scalp to rotate the ball member, the hair grower ejects or soaks out to the pen tip member or a periphery of the pen tip member.

In the pen-type chemical applicator according to the first aspect of the invention, a ball member is rotatably provided at the pen tip member, and the pen tip member is constructed so that, when the pen tip member is moved under the condition that the pen tip member is brought into contact with a scalp to rotate the ball member while pressing side portions or parts of the pen-like body with the user's fingers, the hair grower ejects or soaks out to the pen tip member or a periphery of the pen tip member.

In the pen-type chemical applicator according to the first aspect of the invention, the pen tip member is constructed so that the pen tip member is retractable inwardly against a spring force by pressing the pen tip member, and is constructed so that, when the pen tip member is retracted inwardly, the hair grower ejects or soaks out to the pen tip member or a periphery of the pen tip member.

In the pen-type chemical applicator according to the first aspect of the invention, the pen tip member is constructed so that the pen tip member is retractable inwardly against a spring force by pressing the pen tip member, and is constructed so that, when the pen tip member is retracted inwardly while pressing side portions or parts of the pen-like body with the user's fingers, the hair grower ejects or soaks out to the pen tip member or a periphery of the pen tip member.

In accordance with a second aspect of the invention, there is provided a pen-type chemical applicator wherein a pen tip member is provided at a distal end portion of a sleeve-like pen-like body which may be gripped by one hand and which contains a liquid, semisolid, a paste-like, a sol-like, or a gel-like scalp applicable chemical; the head applicable chemical ejects or soaks out to the pen tip member or in the vicinity of the pen tip member; and the sharpness of the pen tip member is set to a stimulus that does not give a feeling of pain to a scalp when the pen tip member is brought into contact with the scalp.

According to a third aspect of the invention, there is provided a pen-type chemical applicator wherein a pen tip member is provided at a distal end portion of a sleeve-like pen-like body which may be gripped by one hand and which contains a liquid, semisolid, a paste-like, a sol-like, or a gel-like cosmetic or aesthetic cosmetic chemical; the cosmetic chemical ejects or soaks out to the pen tip member or in the vicinity of the pen tip member; and the sharpness of the pen tip member is set to a stimulus that does not give a feeling of pain to a scalp when the pen tip member is brought into contact with the scalp.

In the pen-type chemical applicator according to any aspect of the invention, at least one of the pen-like body and the pen tip member is made of material having an anti-bacteria or bacteria proof property, or an anti-bacteria or bacteria proof property process is applied to at least one of the pen-like body and the pen tip member.

DESCRIPTION OF THE PREFERRED EMBODIMENTS

The present invention will now be described with reference to the accompanying drawings.

Figure 1:
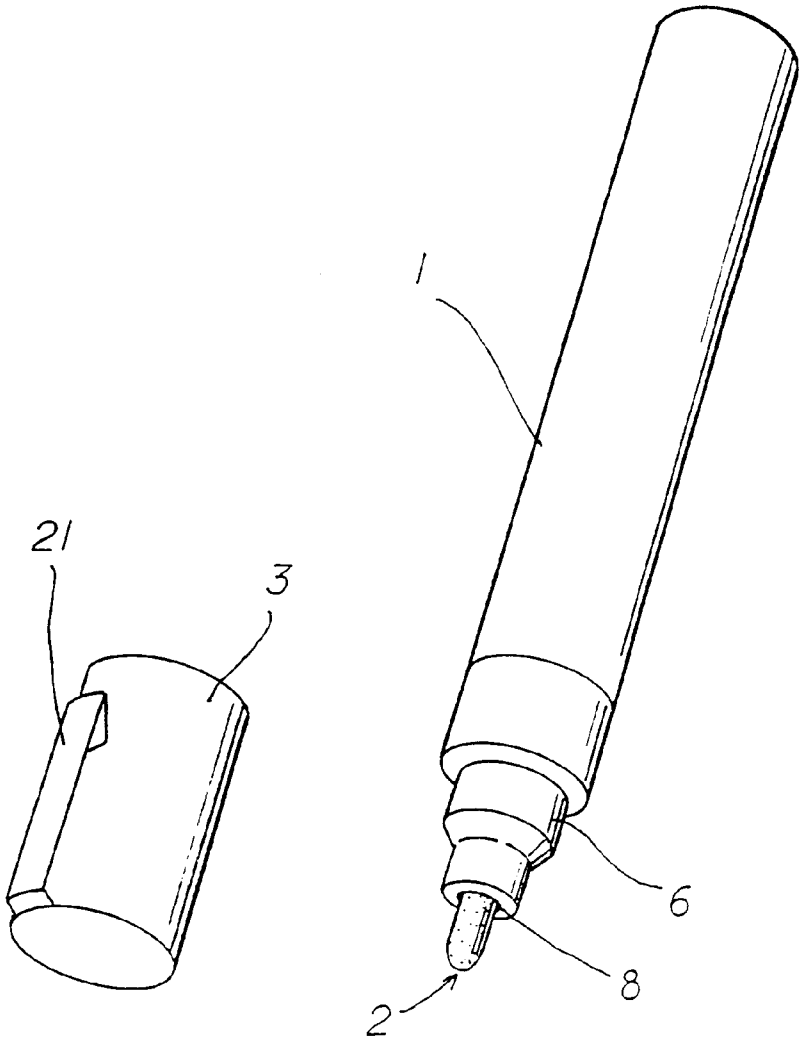
FIG. 1 is a perspective view of a first embodiment of the invention.
Figure 3:
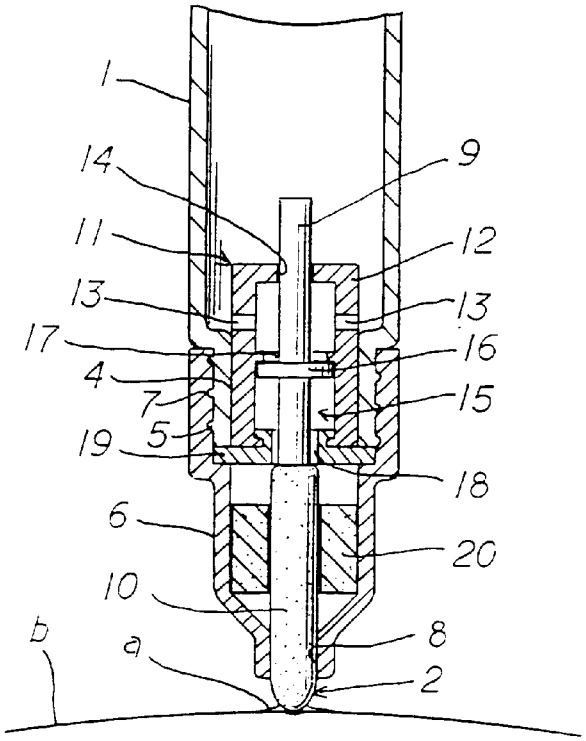
FIG. 3 is an illustrative cross-sectional view showing a state where the pen tip member is brought into contact with the scalp and retracted to thereby apply a hair grower to the scalp.
Figure 2:
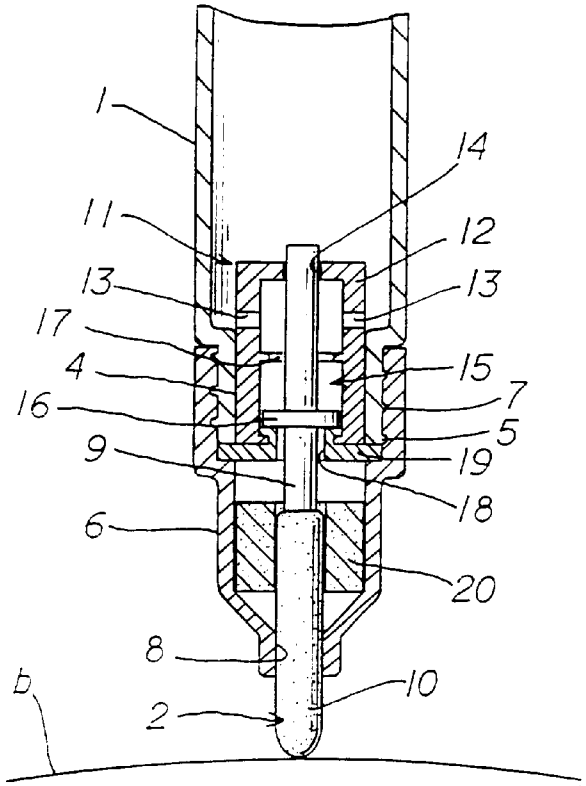
FIG. 2 is an illustrative cross-sectional view showing a state where the pen tip member according to the first embodiment is brought into contact with a scalp.

FIGS. 1 to 3 show a first embodiment of the invention.

According to the embodiment, an applicator is of a pen type which is generally used in a regular line marker.

In the embodiment, a liquid hair grower a is contained in a pen-like body 1. A pen tip 2 into which the hair grower a soaks is provided at a distal end portion of the pen-like body 1. A cap member 3 may be detachably attached to the distal end portion of the pen-like body 1 for opening/closing the pen tip 2.

Accordingly, the applicator is constructed so that, by closing the pen tip member 2 with the cap member 3 when the applicator is not in use, the hair grower is prevented from contacting with or soaking a user's personal belongings when the user brings the applicator with him or her.

Also, a clip 21 is provided on the cap member 3 so that the pen-like body 1 may readily be carried with the user with the clip 21 being hooked to his or her pocket or the like.

A more detail description follows.

The pen-like body 1 is formed of a bottomed sleeve-like member so that the user can grip the body with one hand. An opening portion at the tip of the pen-like body 1 is formed to have a somewhat decreased diameter. A male screw 5 is formed around an outer circumferential surface of the decreased diameter portion 4.

A pen tip mounting member 6 having a cross-section as shown in FIGS. 2 and 3 is provided on the decreased diameter portion 4 at the tip end of the pen-like body 1 in a one-piece manner with the tip end of the pen-like body 1 by screwing a female screw, formed on an inner circumferential surface of a proximal portion of the pen tip mounting member 6, onto the above-described male screw 5.

The pen tip member 2 which is made by coating a distal end portion of an elongated core member 9 with a pen member 10 having an extractive or liquid permeative property is inserted into a mounting hole 8 at the tip end of the pen tip mounting member 6 so that the pen tip member 2 is projected to some extent from the mounting hole 8 of the pen tip mounting member 6.

In the embodiment, the shape of the pen tip member 2 is formed into a curved shape having a sharpness for imparting a stimulus, yet sufficiently dull so as not to inflict pain when pressed against the scalp b during application of the chemical to the scalp.

Accordingly, since the user does not feel any pain when the pen tip member 2 is pushed against the scalp b, the user will not be reluctant to push the pen tip member 2 against the scalp b.

Also, the pen tip member 2 according to the embodiment has a length of about 8 mm and a small diameter of about 5 mm.

Accordingly, since the pen tip member 2 is thus formed to be thin, it is possible to bring the pen tip member 2 into contact with the scalp b through the hairs on the scalp.

The pen tip member 2 is arranged so that the pen tip member 2 may be moved inwardly of the pen tip mounting member 6 by pushing the pen tip member 2. In accordance with the inward movement of the pen tip member 2, the core member 9 is moved inwardly of the pen-like body 1. An introduction mechanism 11 for introducing the hair grower a into the pen tip mounting member 6 is provided within the decreased diameter portion 4 at the tip end of the pen-like body 1. By pushing the pen tip member 2, the hair grower a within the pen-like body 1 may eject into or soak out to the pen member 10 of the pen tip member 2.

The introduction mechanism 11 will be described in more detail.

An intermediate member 12 that is formed so as to be inserted into and arranged within the decreased diameter portion 4 as shown in FIGS. 2 and 3 is arranged within the decreased diameter portion 4 of the pen-like body 1.

The intermediate member 12 is made into a hollow shape having opening at its upper side. Introduction holes 13 are formed on a side wall closer to the bottom (in an up-side-down state) of the intermediate member 12 for introducing the hair grower a, contained in the pen-like body 1, into a space 15 within the intermediate member 12. An inside through-hole 14, through which the core member 9 of the pen tip member 2 is caused to pass, is formed in a central portion of the bottom portion of the intermediate member 12.

A disc-like closure member 19 having a diameter greater than that of the intermediate member 12 is fixed to the upper opening portion of the intermediate member 12. An outside through-hole 18 which is somewhat greater in diameter than the core member 9 and through which the core member 9 is caused to pass is formed in the central portion of the closure member 19.

The outer circumferential edge portion of the closure member 19 is retained on the upper edge of the decreased diameter portion 4. The pen tip mounting member 6 is threadly engaged with the decreased diameter portion 4 so that the intermediate member 12 is fixed to the decreased diameter portion 4. In this case, the core member 9 of the pen tip member 2 inserted into the mounting hole 8 at the tip portion of the pen tip mounting member 6 is caused to pass through the outside through-hole 18 of the closure member 19 and the inside through-hole 14 of the intermediate member 12 so that the core member 9 is interposed in the space 15.

A disc-like valve member 16 having a diameter somewhat greater than that of the outside through-hole 18 is formed in a midportion of the core member 9 within the space 15. The valve member 16 is arranged on the opening side of the intermediate member 12 within the space 15. A retainer piece 17 for retaining the valve member 16 at the intermediate portion of the space 15 for preventing the valve member 16 from moving toward the bottom side of the space 15 in the intermediate member 12 is formed to project toward the center of the space 15.

Accordingly, the above-described valve member 16 is movable between the closure member 19 and the retainer piece 17 within the closed space 15. The core member 9 is moved in this allowed range so that the pen tip member 2 may be projected or retracted.

Also, although not shown, a spring member having a suitable spring force is arranged along the core member 9 between the valve member 16 and the bottom of the space 15 within the intermediate member 12. The core member 9 is normally biased outwardly by the spring member so that the pen tip member 2 may be kept under the state that the pen tip member 2 projects from the pen tip mounting member 6. By pressing the pen tip member 2 against the biasing force, the pen tip member 2 may be retracted inwardly.

In this embodiment, the spring force of the spring member is set to such a level that, when the pen tip member 2 is pressed against the scalp to be retracted, a suitable stimulus having a massage effect for the scalp b may be applied by the pen tip member 2.

Accordingly, when the pen tip member 2 is pushed against the scalp b to be retracted by the spring force of the spring member, a suitable stimulus is given to the scalp b as the pen tip member 2 massages the scalp. Accordingly, the scalp cells are activated and the hair growing effect by the hair grower a is further enhanced.

Accordingly, under the condition that the core member 9 is biased outwardly by the spring member so that the valve member 16 is brought into contact with the closure member 19 to close the outside through-hole 18, the hair grower a is not flowed out of the outside through-hole 18. However, when the pen tip member 2 is depressed against the biasing force of the spring member to be retracted inwardly, the valve member 16 is moved inwardly so that the hair grower a contained in the pen-like body 1 is flowed into the pen tip mounting member 6 through the introduction hole 13 from the gap between the core member 9 and the outside through-hole 18 having a diameter somewhat greater than that of the core member 9. The hair grower soaks the pen member 10 of the pen tip member 2 and flows out of the pen tip member 2.

Also, in this embodiment, the pen tip member 2 is coated with an antibiotic so that bacteria will not form on the pen tip member 2.

Accordingly, while in the conventional product there is an advantage that a large amount of the hair grower a may be contained. due to the large amount stored within the container, it takes many days to consume the hair grower. As a result, in many cases, various bacteria grow in the vicinity of mouth of the bottle and discharacterize or degrade the hair grower a in the bottle. At the worst, the hair grower a would be discharacterized to a depilatory accelerator. However, the pen-type chemical applicator according to the embodiment may resolve this problem.

Also, even without any antibacterializing process, since a single pen-type chemical applicator according to the embodiment contains an amount of hair grower which may be used up for about two days to one week, it is possible to avoid the propagation of unwanted bacteria. However, the antibacterializing process may further enhance a safety property and improve the commercial value.

Therefore, according to the invention, it is possible to apply the hair grower in a safer manner for attaining the inherent object of the product and it is possible to avoid the discharacteristics or degradation due to the bacteria or the like. It is therefore possible to enjoy the inherent effect of the hair grower a.

Incidentally, in the embodiment, the antibacterial characteristics are only given to the pen tip member 2. However, it is possible to equally apply the antibacterial characteristics to both the pen tip member 2 and the pen-like body 1 or only to the pen-like body 1.

Accordingly, in the embodiment, if the pen-like body 1 is gripped by one hand of the user and the pen tip member 2 is pushed against the scalp, the pen tip member 2 is retracted inwardly against the spring force of the pen tip member 2 so that the hair grower a will eject or soak into the pen tip member 2. It is possible to suitably apply the hair grower a to the scalp b while giving stimulus to the scalp b by the spring force of the above-described spring member and activating the scalp cells.

Also, since the hair grower a is applied while imparting the stimulus to the scalp b, unlike the conventional product, the user may positively and immediately know where the hair grower a is applied in the scalp b at any time. For this reason, it is possible to readily apply a suitable or desired amount of the hair grower a to a part to be desired.

In the actual use of the conventional product where the chemicals are filled in a container such as a glass bottle, there is a fear that there are some parts where the chemicals are applied too much to the scalp b and other parts where the chemical are applied too little. Accordingly, the user frequently feels a bad sense about that. However, according to the pen-type chemical applicator according to the embodiment, it is possible to quite easily solve such a problem.

Also, a variety of unwanted bacteria that propagate in the conventional product include some bacteria that propagate due to the nutriment of the hair grower a. Accordingly, there is a fear that when the conventional hair grower a is applied to the scalp, the variety of bacteria are unconsciously caused to propagate. However, in the pen-type chemical applicator according to the embodiment, since it is possible to avoid the propagation of the bacteria as described above, it is easy to solve this problem.

Also, it is possible to suppress the cost of the complete product in comparison with the conventional product due to the fact that according to the present invention the amount of the hair grower a to be contained is small and the parts are made in low cost.

Also, since the chemical applicator is very light in weight and may readily be carried in a pocket of the cloth of the user due to the pen-like shape, it is very convenience for carriage. Even if a large number of the chemical applicators are kept, there is almost no substantial space for storage. Thus, it is also easy for keeping the chemical applicators for storage.

Reference numeral 20 denotes a liquid absorbing material for preventing the hair grower a, flowed into the pen tip mounting member 6, from soaking out too much.

Figure 4:
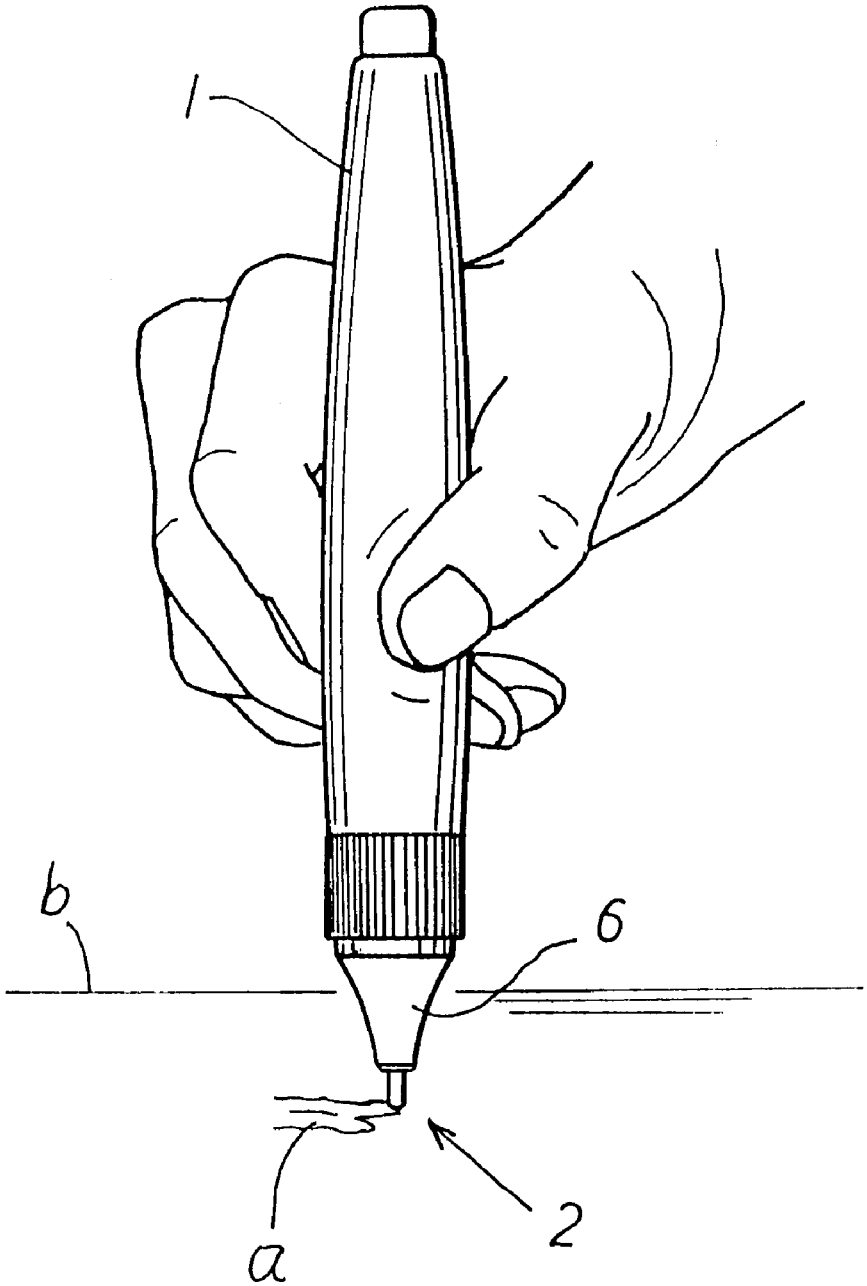
FIG. 4 is an illustration showing a state where a hair grower is applied to the scalp according to a second embodiment.

FIG. 4 shows a second embodiment of the invention.

This embodiment relates to the case where a pen tip member 2 is constructed in a pen tip structure which has been adapted to a pen-type correction liquid product or the like. More particularly, a thin sleeve member is projected from a distal end portion of the pen tip mounting member 6. A short axial core (not shown) is inserted into the distal end portion of the sleeve member and pressed inwardly, so that the short axial core may be retracted inwardly against the spring force. By depressing and retracting the axial core inwardly, the hair grower a will soak or eject from a gap between the axial core and the sleeve member. Under this condition, the side portions (barrel portions) of the pen-like body 1 is depressed by the fingers so that the hair grower a will soak or eject from the above-described position.

Accordingly, since the pen tip member 2 is constructed by adopting the pen tip structure which is used in the conventional pen type correction liquid product or the like, it is possible to readily make the pen tip member 2.

Also, the applicator is so constructed that if the axial core of the pen tip member 2 is depressed inwardly, the hair grower a will not eject or soak out unless the side portions of the pen-like body 1 are also depressed by the fingers while the pen tip member 2 is depressed inwardly. Accordingly, for example, if the pen-like body 1 is placed in a shirt pocket, even if the axial core is moved inwardly, there is no risk of the hair grower a leaking out to stain or soak into the cloth.

Incidentally, it is possible to construct the applicator so that the hair grower a soaks or eject from the pen tip member 2 only by pushing the axial core of the pen tip member 2 inwardly. In such a structure, in view of the foregoing points, it is preferable to provide a cap like the first embodiment.

Also, this embodiment shows the case where the barrel portions of the pen-like body 1 is depressed. However, the portions to be depressed may be provided in any position of the pen-like body 1. It is of course possible to effect any design around.

Also, in this embodiment, the diameter of the thin sleeve member for forming the pen tip member 2 is determined so as to give to the scalp b the stimulus that does not impart any pain to the scalp b when the pen tip member 2 is brought into contact with the scalp b.

Accordingly, since no pain is felt when the pen tip member 2 is brought into pressing contact with the scalp b, it is possible to bring the pen tip member 2 into contact with the scalp b without any hesitation.

Accordingly, when the side portions of the pen-like body 1 are pressed by the fingers while gripping the pen-like body 1 by one hand and contacting the pen tip member 2 against the scalp b, the hair grower a ejects or soaks from the pen tip member 2. At the same time, a suitable stimulus is applied to the scalp b by the pen tip member 2 to activate the scalp cells and to apply the hair grower a to the scalp b.

Figure 5:
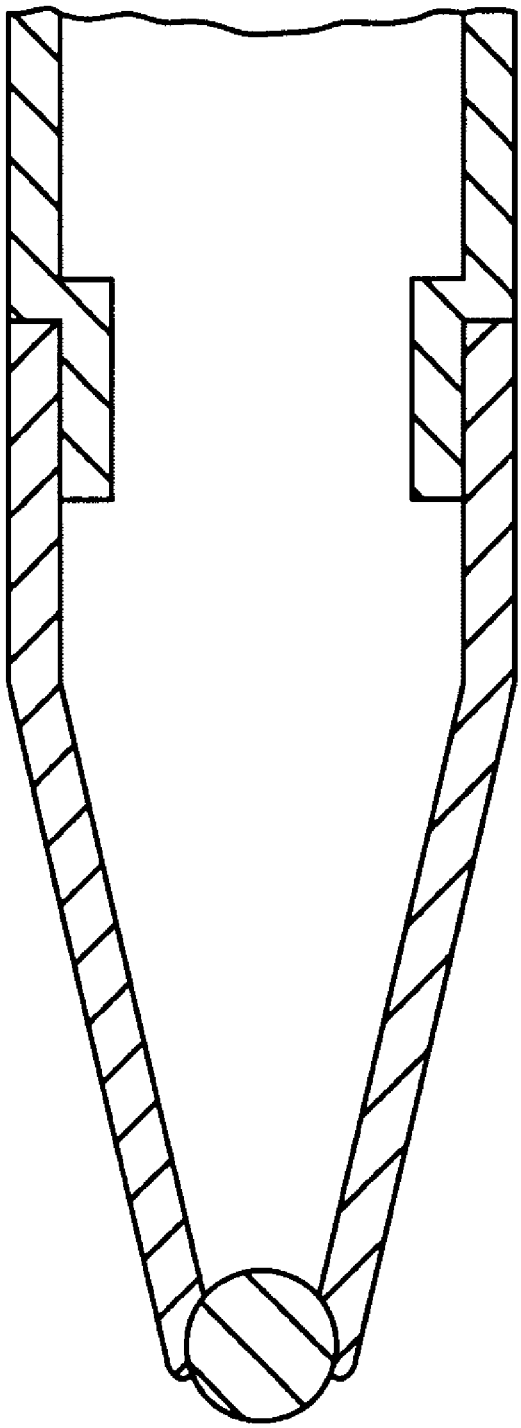
FIG. 5 is a cross-sectional view showing a pen-type applicator having a ball member rotatably provided at the pen tip.

Incidentally, the structure of the pen tip member 2 is riot limited to the first and second embodiments of the invention. For example, it is possible to adopt a pen tip structure such as a ball point pen structure as shown in FIG. 5.

Also, in either of the first and second embodiments, the retracting structure is provided for the pen tip member 2 and the hair grower a ejects or soaks from the pen tip member 2 by the retraction movement of the retracting structure. However, it is possible to adopt a structure that the hair grower a soaks or ejects from the pen tip member 2 naturally without providing any retracting structure.

Also, the pen tip member 2 is formed into a shape having a sharpness for giving a stimulus that does not impart a feeling of pain when the pen tip member is pressed against the scalp b. Also, it is possible to take a pen tip shape that may impart a like stimulus to the scalp b by a cushioning function or to make the pen tip member 2 of a cushioning material that may impart the like stimulus to the scalp b.

Also, it is possible to provide a pressure portion in the form of a sphere to a proximal portion of the pen tip member 2, for example, to retract the pen tip member 2 inwardly of the pressure portion to thereby cause the hair grower a to soak or eject from the pen tip member 2; or otherwise to provide the pen tip member 2 into the pressure portion in the form of a sphere in an embedded manner to bring the pen tip member 2 into contact with the scalp b by pressing the pressure portion against the scalp b to thereby cause the hair grower a to eject or soak from the pen tip member 2. If such a structure is taken, since the pressure portion stimulates the scalp b over a wide surface pressure, it is possible to ensure a more massage effect.

Also, in either of the first and second embodiments, there is shown a case where the hair grower a is contained in the penlike body 1 for the applicator of the hair grower a to the scalp b. It is possible to use any kind of chemicals such as a tonic or a lotion which is used to be applied to a human head in the pen-like body 1.

Also, it is possible to use the device of the present invention as an applicator for a cosmetic agent a by containing the cosmetic agent a such as a cosmetic lotion or beauty liquid which is suited for being applied while the skin b is physically stimulated. In such an application, it is possible to use the device according to the invention as a superior applicator for cosmetic agent a that may be applied to the skin b while the skin cells are cultivated with a suitable physical stimulation on the skin b.

As described above, the present invention has a structure that causes the hair grower or scalp chemicals to soak or eject to the pen tip member or around the pen tip member while in direct contact with the scalp. It is therefore possible to effectively eliminate waste which occurs when the chemicals are applied to the hair rather than the scalp. It is also possible to easily and effectively apply the desired amount of the chemicals to the area of the scalp desired. It is therefore possible to very effectively apply the hair grower or restoration agent or the scalp applicable chemical to the scalp. In addition, since the sharpness of the pen tip member is set so that pain is not felt by the scalp when the applicator touches the scalp, it is possible to apply the hair grower or scalp applicable chemical while activating the scalp cells with a stimulus to the scalp in a very moderate manner. Thus, it is possible to further enhance an effectiveness of the hair grower or a scalp applicable chemical. Accordingly, according to the present invention, it is possible to provide a pen-type chemical applicator that is very practical and effective as described above.

Furthermore, since the pen-like body is gripped by one hand and the hair grower or scalp applicable chemical is applied to the scalp from the pen tip member, the step for rubbing the hair grower or scalp applicable chemical in the scalp or massaging the scalp by the user's fingers or palms may be made simultaneously with the application of the chemical in the application process. Accordingly, such a step may be dispensed with. As a result, it is possible to simultaneously solve a problem of bacteria forming on to the scalp from the user's hands or fingers in a conventional manner. Thus, at once, it is possible to solve any trouble that the inherent effect of the chemicals would be discharacterized or degraded. It is therefore possible to perform the hair grower application in a very safety manner.

Also, since it is possible to prevent the contamination of the hands and perform the application with ease, it is possible for a user of no patience to continuously use the applicator for a long period of time.

Also, since the pen-like body is made into a size that may be gripped by one hand, the applicator is superior in portability, and it is possible to carry the applicator anywhere with the user. Furthermore, storage space may be saved. The applicator is very convenient to use. The aesthetic design thereof is very good. It would be difficult for others to recognize that the application is used for the hair grower or scalp applicable chemical. Accordingly, the user may use the pen-type chemical applicator with ease without any hesitation in front of others anytime, anywhere.

Accordingly, it is possible for the user to carry the applicator anywhere and to apply the hair grower or scalp applicable chemical anywhere without avoiding the public eye. Accordingly, the present invention may provide a novel and practical pen-type chemical applicator that may ensure a sufficient effect of the hair grower or scalp applicable chemical.

Also, according to a second aspect of the invention, the pen tip member is applied directly to the scalp so that the hair grower ejects or soaks out to the pen tip member or in the vicinity of the pen tip member. Accordingly, it is possible to positively and easily apply a desired amount of the hair grower to a part to be coated.

Also, according to a third aspect of the invention, a part or side portions of the pen-like body are depressed by user's fingers under the condition that the pen tip member is brought into contact with the scalp, so that the hair grower ejects or soaks to the pen tip member or in the vicinity of the pen tip member. Accordingly, it is possible to further easily or positively apply only the desired amount of the hair grower to the part to be coated.

Also, according to a fourth aspect of the invention, the pin tip member is moved to rotate a ball member while the pen tip member is being brought into contact with the scalp, so that the hair grower soaks or ejects to the pen tip member or in the vicinity of the pen tip member. It is possible to more easily apply the desired amount of the hair grower to the parts to be coated without fail.

Also, according to a fifth aspect of the invention, the ball member is rotated by moving the pen tip member while pressing the side portions of the pen-like body or a part thereof by the fingers under the condition that the pen tip member is brought into contact with the scalp. As a result, the hair grower soaks or ejects to the pen tip member or in the vicinity of the pen tip member. Accordingly, it is possible to further easily or positively apply only the desired amount of the hair grower to the part to be coated.

Also, according to a sixth aspect of the invention, the pen tip member is retracted inwardly under the condition that the pen tip member is brought into contact with the scalp so that the hair grower soaks or ejects to the pen tip member or in the vicinity of the pen tip member. Accordingly, it is possible to further easily or positively apply only the desired amount of the hair grower to the part to be coated.

Also, according to seventh aspect of the invention, the pen tip member is retracted inwardly under the condition that the pen tip member is brought into contact with the scalp and the side portions or a part of the pen-like body is pressed by fingers, so that the hair grower soaks or ejects to the pen tip member or in the vicinity of the pen tip member. Accordingly, it is possible to further easily or positively apply only the desired amount of the hair grower to the part to be coated.

Also, the applicator is constructed so that the hair grower does not soak or eject only by retracting the pen tip member inwardly, but also requires the user to press the side portions of the pen-like body or part thereof with the fingers. Accordingly, for example, in the case where the pen-like body is received in the pocket of the cloth, there is no fear that the hair grower leaks to contaminate the cloth even if the pen tip member is retracted inwardly.

Also, according to a ninth aspect of the invention, since the cosmetic or aesthetic cosmetic chemical, which is suitable for application while imparting a stimulus to skin, ejects or soaks out to the pen tip member which is applied directly to the skin or in the vicinity of the pen tip member, a desired amount of the chemical to be applied is positively applied to the part: to be coated with ease. It is therefore possible to very effectively apply the hair grower. Also, the sharpness of the pen tip member is set to the stimulus that would not cause any pain when the pen tip member is brought into contact with the skin. It is therefore possible to apply the chemical to the skin while activating the skin cells by imparting a good stimulation to the skin. Thus, it is possible to actually provide a remarkably superior and practical pen type chemical applicator to enhance the effectiveness of the cosmetic chemical.

Also, since the pen-like body is made into a size that may be gripped by one hand, the applicator is superior in portability, and it is possible to carry the applicator anywhere with the user. Furthermore, storage space for the storage may be saved. The applicator is very convenient to use. The aesthetic design thereof is very good. It would be difficult for others to recognize that the applicator is used for application of the hair grower or scalp applicable chemical. Accordingly, the user may use the pen-type chemical applicator with ease without any hesitation in front of others anytime, anywhere.

Accordingly, it is possible to carry the applicator anywhere and to apply the chemical any time the user desires to apply the chemical, without embarrassment. In comparison with the conventional application method, it is possible to enjoy the inherent effect of the chemical. In addition, there is no possibility that the hands would be contaminated since the pen-like body is used by gripping by one hand and the chemical is applied to skin from the pen tip member. It is thus possible to very easily and lightly use the novel pen-type applicator which is superior in practical use.

Also, according to a tenth aspect of the invention, it is possible to prevent the propagation of bacteria in the pen-like body or the pen tip member, whereby it is possible to prevent the discharacterization or degradation due to the propagation of bacteria in the chemical within the pen-like body or in the chemical leaked from or ejected from the pen tip member.

Accordingly, in the case of the hair restoration agent, it is possible to keep the effect of preventing depilatory and the hair growing acceleration which are inherent objects for the hair grower.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What we claim is:

1. A pen-type chemical applicator for applying a hair grower to a scalp comprising:

a pen-type body capable of being gripped by one hand, said pen-type body containing one of a liquid, semisolid, paste-type, sol-type, and gel-type hair grower;

a smooth, scalp stimulating pen tip member provided at a distal end portion of said pen-type body, so that said hair grower may flow from said pen-type body to said pen tip member; and wherein said smooth, scalp stimulating pen tip member has a shape and size set to impart a stimulus to the scalp when brought into contact with the scalp during the application of the hair grower without causing a user to experience a painful sensation, the pen tip member enables the hair grower to flow from the contact portion of the pen tip member while the pen tip member is pressingly brought into contact with the scalp so that the hair grower may be applied to the scalp, and the pen tip member may impart a stimulus to the scalp without causing a user to experience a painful sensation.

2. The pen-type chemical applicator according to claim 1, further comprising a valve member which is slidably movable between a closed valve position so that the hair grower is prevented from flowing through the tip member, and an open valve position so that said hair grower is free to flow through the tip member; and a biasing force applied to said valve member for biasing the valve in the closed position so that when said pen tip member is pressed against the scalp, said biasing force is overcome and said valve member is moved to the open valve position.

3. The pen-type chemical applicator according to claim 1, further comprising side portions of said pen-type body which respond to a pressing force for causing the flow of said hair grower from said pen-type body to said pen tip member while said pen tip member is pressed against the scalp.

4. The pen-type chemical applicator according to claim 1, further comprising a ball member rotatably supported at an end of said pen tip member so that, when said pen tip member is moved under the condition that said pen tip member is brought into contact with the scalp to rotate said ball member, the hair grower flows around said ball member.

5. The pen-type chemical applicator according to claim 1, further comprising:

a ball member rotatable supported at an end of said pen tip member, so that, when said pen tip member is moved under the condition that said pen tip member is brought into contact with the scalp to rotate said ball member, said hair grower flows around said ball member; and side portions of said pen-type body which respond to a pressing force for causing the flow of said hair grower from said pen-type body to said pen tip member while said pen tip member is brought into contact with the scalp.

6. The pen-type chemical applicator according to claim 1, further comprising a spring force for biasing said pen tip member; and wherein said pen tip member is retractable inwardly against said spring biasing force by pressing said pen tip member so that the hair grower may flow through said pen tip member.

7. The pen-type chemical applicator according to claim 1, further comprising:

a spring force for biasing said pen tip member, wherein said pen tip member is retractable inwardly against said spring biasing force by pressing said pen tip member against the scalp so that said hair grower may flow through said pen tip member; and side portions of said pen-type body which respond to a pressing force for causing the flow of said hair grower from said pen-type body to said pen tip member while said pen tip member is pressed against the scalp.

8. A method of applying a hair grower to a scalp comprising the steps of:

providing a pen-type applicator having:

a pen-type body adapted to be gripped by one hand, said pen-type body containing one of a liquid, semisolid, paste-type, sol-type, and gel-type hair grower;

a smooth, scalp stimulating pen tip member provided at a distal end portion of the pen-type body, so that said hair grower may flow from said pen-type body to said pen tip member;

wherein said smooth, scalp stimulating pen tip member has a shape and size set to impart a stimulus to the scalp when brought into contact with the scalp during an application of the hair grower without causing a user to experience a painful sensation, and wherein the pen tip member enables the hair grower to flow from the contact portion of the pen tip member while the pen tip member is pressingly brought into contact with the scalp so that the hair grower may be applied to the scalp; and pressing said pen tip member to the scalp so as to dispense said hair grower contained in said pen-type applicator onto the scalp and so as to simultaneously impart the stimulus to the scalp.

* * * * *